US005383232A

United States Patent [19]

Gabbay et al.

[11] Patent Number: 5,383,232

[45] Date of Patent: Jan. 17, 1995

[54] ROTATING ANODE FOR COMPOSITE X-RAY TUBE

[75] Inventors: Emile Gabbay, Paris, France; Werner Roeck, Irvine, Calif.

[73] Assignee: GE Medical Systems S.A., Buc, France

[21] Appl. No.: 136,080

[22] Filed: Oct. 15, 1993

[30] Foreign Application Priority Data

Oct. 15, 1992 [FR] France ..... 92 12361

[51] Int. Cl.[6] ..... H01J 35/08

[52] U.S. Cl. ..... 378/124; 378/144

[58] Field of Search ..... 378/124, 144

[56] References Cited

U.S. PATENT DOCUMENTS 3,229,089 1/1966 Sasao ..... 250/65

4,523,327 6/1985 Eversole ..... 378/124

4,847,883 7/1989 Fourre ..... 378/144

FOREIGN PATENT DOCUMENTS 3117726 12/1982 Germany .

3532822 3/1987 Germany .

*Primary Examiner*—Craig E. Church

*Attorney, Agent, or Firm*—Kerkam, Stowell, Kondracki & Clarke

[57] ABSTRACT

Disclosed is a rotating anode for a composite X-ray tube formed by two half-anodes, each being in the form of a disk, one face of which is flat and the other face of which is cut out into radial notches that join their indented circumference to the center of said half-anodes which fit into each other by their indented faces and are fixedly attached by a mechanical fixing system.

3 Claims, 2 Drawing Sheets

ROTATING ANODE FOR COMPOSITE X-RAY TUBE

BACKGROUND OF THE INVENTION

1. Field of the Invention

The present invention relates to a rotating anode for an X-ray tube, simultaneously emitting the radiation spectra of two distinct materials.

2. Description of the Prior Art

An X-ray tube is constituted by a rotationally symmetrical block, for example a disk or truncated cone, with a substrate that is coated on one face with a layer of material having a high atomic number, namely a metal such as molybdenum, tungsten or rhodium for example. In a glass bulb in which a high vacuum prevails, there is placed a cathode made of a thermoelectronic emitter such as a tungsten filament, designed to emit an electron beam focused on the anode which is itself enclosed in the bulb. When the filament of the cathode is made incandescent and when the anode has been taken to a positive potential of some kilowatts with respect to the cathode, then the electrons emitted by the cathode are accelerated towards the anode by the electrical field created between the two electrodes, and they impinge upon a surface of the anode called the X-ray focal spot. This zone of impact of the electrons becomes the main source of emission of the X-rays throughout the space facing the anode, except at the glancing incidences. In another type of embodiment, it is the edge of the anode that is coated with a layer of material having a high atomic number, the cathode being then positioned in such a way that it emits an electron beam on the focal spot of the anode located on the edge.

The radiation output of an X-ray tube depends on factors such as the stream of electrons, the difference in potential between the cathode and the anode and the atomic number of the material constituting the target of the electron beam.

In the application of an X-ray tube to medical diagnosis, it is important that the properties of this tube should enable very high quality of the exposures obtained, taking account of the tissues to be radiographed. The quality of the exposures is defined by the sharpness and the contrast which are related to the following factors:

—the distribution in density of the electrons, emitted by the cathode, on the surface of the focal spot of the anode;

—the place at which the secondary electrons emitted by the cathode or any other parasitic emission fall, outside the focal spot of the anode;

—the spectrum of the X-radiation used in relation to the object to be radiographed.

SUMMARY OF THE INVENTION

It is an object of the present invention to improve the quality of the image obtained in radiology, by acting on the spectrum of the X-radiation emitted by the X-ray tube. In certain particular applications, it is necessary for the radiation to be composite, notably when the object to be radiographed is constituted by parts having different consistencies, "soft" and "hard", that are each at the same time compatible with a wavelength of radiation.

The invention concerns a rotating anode for a composite X-ray tube, placed in front of a cathode in a vacuum glass chamber, wherein said rotating anode is constituted by a rotationally symmetrical block formed by different materials with a high atomic number, arranged with respect to each other in such a way that they are chemically independent and alternately subjected to bombardment by an electron beam emitted by the cathode.

Another embodiment of the invention concerns a rotating anode for a composite X-ray tube the focal spot of which is located on the edge, placed in front of a cathode in a vacuum glass chamber, wherein said anode is constituted by two half-anodes, each being made of a material with a different, high atomic number alternately subjected to the bombardment of an electron beam emitted by the cathode, each being in the form of a disk, one face of which is flat and the other face of which is cut out with radial notches that join their indented circumferences respectively to the centers of said half-anodes which fit into each other by their indented faces which are fixedly attached by a mechanical fastening system.

BRIEF DESCRIPTION OF THE DRAWINGS

Other features and advantages of the invention shall appear from the following description of exemplary embodiments of an anode, illustrated by the appended drawings, of which.

MORE DETAILED DESCRIPTION

The figures bearing the same references in the different figures fulfil the same functions with a view to obtaining the same results.

With regard to the contribution of the radiation spectrum of the source formed by an X-ray tube to the sharpness and contrast of the image obtained by radiography, it has been noted that the X-radiation observed is not monochromatic but contains a wide spectrum of different wavelengths. Starting from the shortest wavelength or the highest frequency, all the frequencies of lower values are shown. The highest frequency F is given by the formula:

$$e.V = h.F, \text{ that is } F = \frac{e.V}{h}$$

where V is the voltage, in kilovolts, applied between the two electrodes of the X-ray tube, e is the charge of the electron and h is the universal Planck's constant. The frequency F is therefore expressed in kiloelectronvolts.

The radiation spectrum comprises, firstly, a continuous background of radiation of all the frequencies, due to the deceleration in varying degrees of completeness, on the surface of the anode, of the electrons emitted by the cathode, said continuous background emitting X-rays with a corresponding energy value, the frequencies F of which are such that:

$$F \leqq \frac{e.V}{h}$$

The spectrum furthermore comprises the characteristic lines of the anode emissive material with high atomic number which are due to the collision of the incident electron from the cathode with one of the electrons in orbit around the nucleus of the atom of the emissive material. This emission of characteristic lines of the atom of the material of the anode is produced by the passage of an electron from an external orbit to an internal orbit.

In order to radiograph more specifically soft and absorbent tissues like those of premature babies for example, it would be particularly valuable to superpose these two spectra to obtain one part of the spectrum which results from One of the two emissive materials and the other part of the spectrum which results from the other emissive material. In the prior art, this rarely treated problem was dealt with only with an anode constituted by a composite material in the form of an alloy. However, alloys have various drawbacks, which are major ones in the application of such an anode in medical diagnosis. Amongst these drawbacks are the fact that their melting point is far lower than that of the pure metals, and that their thermal conductivity is always lower than that of each metal forming these alloys.

Figure 1:
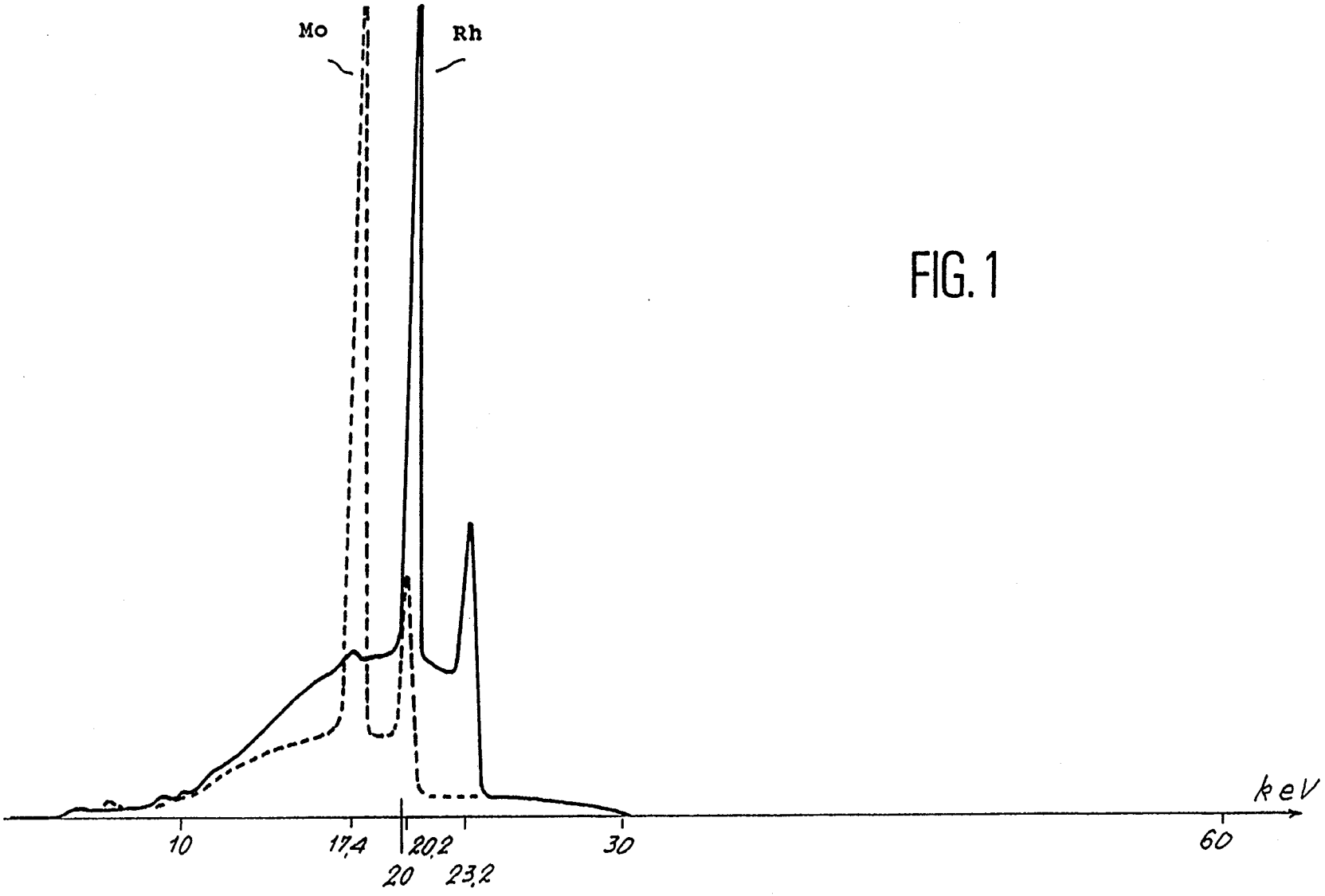
FIG. 1 shows the spectrum of radiation emitted by an anode made according to the invention.

The invention resolves these problems by proposing an anode constituted by two different emissive materials with a high atomic number. To obtain maximum contrast between the air and the soft tissues to be radiographed, it is necessary to compute the frequencies in kiloelectronvolts that make it possible to optimize the choice of the emissive materials of the anode. Thus, as is shown in FIG. 1, the X-radiation spectrum obtained with such an anode formed by molybdenum and rhodium, the high voltage of which is 30 kilovolts, comprises, in addition to the continuous background ranging from 0 to 30 keV, the spectral lines of molybdenum at 17.4 and 20 keV and rhodium at 20.2 and 23.2 keV.

To obtain such a spectrum, the invention proposes an anode made out of two different emissive materials that are in a configuration such that they remain chemically independent and are subjected alternately to the electron bombardment coming from the cathode.

Figure 2:
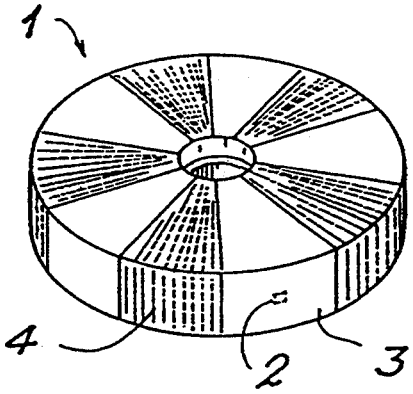
FIG. 2 shows a first embodiment of an anode according to the invention.

FIG. 2 shows a first embodiment of an anode 1 according to the invention having, for example, the shape of a flat disk and having an X-ray focal spot 2 located either on the face of the disk facing the cathode or on the edge 3. It is constituted by a succession of sectors 4 of the two emissive materials that are alternately positioned. It may also be constituted by a substrate, said face and edge of which comprise deposits, in alternating sectors, of the two emissive materials.

Figure 3:
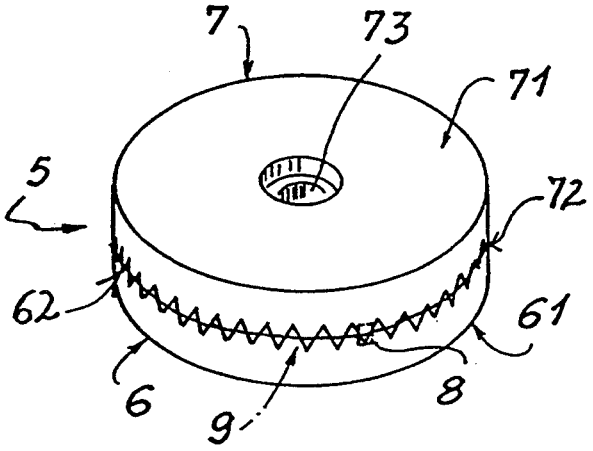
FIG. 3 shows a second embodiment of an anode according to the invention.
Figure 4:
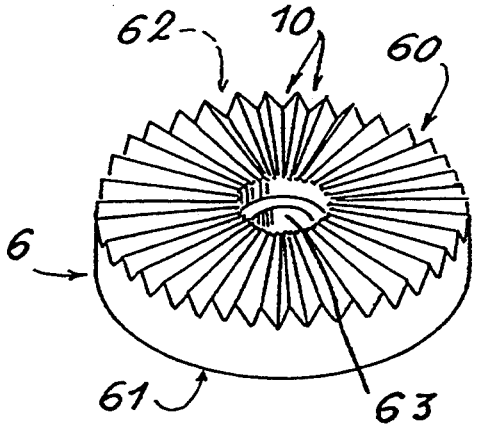
FIG. 4 shows a half-anode used to make an anode according to the invention.

FIG. 3 shows a second embodiment of an anode 5 according to the invention, made out of two half-anodes 6 and 7, one of which is shown in FIG. 4. Each of them is in the form of a disk having a center of symmetry and of rotation 63 and 73 respectively. In each of these disks, one face, 61 and 71 respectively, is flat while the other face, 62 and 72 respectively, is cut out radially from the center 63 and 73 respectively towards its respective indented circumference. These two half-anodes 6 and 7 get fitted into each other by their indented faces 62 and 72, for the notches 10 that are made in the faces 62 and 72 of the half-anodes 6 and 7 and that join the circumferences to the centers 63 and 73 are designed to grip the two half-anodes to each other. A mechanical fastening system, by screws for example, fixedly attaches the two half-anodes to each other. In this exemplary embodiment, the notches 10 made in the faces 62 and 72 have a triangular-sectioned, sawtoothed shape. This embodiment, which has great simplicity, calls for only one mechanical operation. The position chosen for the focal spot 8 of the X-radiation, in relation to the median line 9 of the junction between the half-anodes, at the two indented circumferences, makes it possible to achieve a proportioning of the mixing of the spectra of the two emissive materials of the anode. If the focal spot is on this median line, the resulting radiation spectrum will be a mixture with 50% of the spectrum of each of the materials. A different percentage between the two spectra may be obtained by modifying the position of the focal spot 8 with respect to the median line 9.

Figure 5:
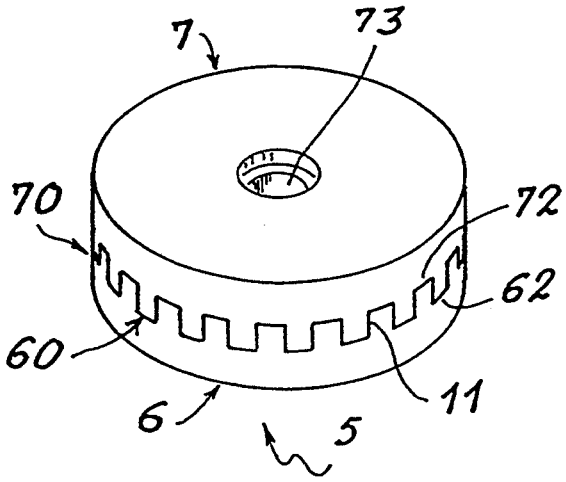
FIG. 5 shows a third embodiment of an anode according to the invention.

FIG. 5 shows a third embodiment of an anode 5 according to the invention, constituted by two half-anodes 6 and 7, the radially notched faces 62 and 72 of which have a circumference 60 and 70 respectively, cut out into rectangular indentations 11.

What is claimed is:

1. A rotating anode for a composite X-ray tube the focal spot of which is located on the edge, placed in front of a cathode in a vacuum glass chamber, wherein said anode is constituted by two half-anodes, each being made of a material with a different, high atomic number alternately subjected to the bombardment of an electron beam emitted by the cathode, each being in the form of a disk, one face of which is flat and the other face of which is cut out with radial notches that join their indented circumferences respectively to the centers of said half-anodes which fit into each other by their indented faces which are fixedly attached by a mechanical fastening system.

2. An anode according to claim 1, wherein the notches have a triangular-sectioned, sawtoothed shape.

3. An anode according to claim 1, wherein the notches have the shape of rectangular indentations.

* * * * *